US012799829B2

(12) United States Patent
Sammatti

(10) Patent No.: US 12,799,829 B2
(45) Date of Patent: Nov. 17, 2026

(54) DRILL BIT AND METHOD FOR DRILLING HOLE FOR PIPE TO BE INSTALLED IN GROUND

(71) Applicant: Mincon Nordic Oy, Ylöjärvi (FI)

(72) Inventor: Jussi Sammatti, Ylöjärvi (FI)

(73) Assignee: Mincon Nordic Oy, Ylöjärvi (FI)

( * ) Notice: Subject to any disclaimer, the term of this patent is extended or adjusted under 35 U.S.C. 154(b) by 0 days.

(21) Appl. No.: 18/862,128

(22) PCT Filed: May 3, 2023

(86) PCT No.: PCT/FI2023/050240
§ 371 (c)(1),
(2) Date: Oct. 31, 2024

(87) PCT Pub. No.: WO2023/214118
PCT Pub. Date: Nov. 9, 2023

(65) Prior Publication Data

US 2025/0270881 A1 Aug. 28, 2025

(30) Foreign Application Priority Data

May 3, 2022 (FI) ..... 20225378

(51) Int. Cl.
*E21B 10/26* (2006.01)
*E21B 7/20* (2006.01)

(52) U.S. Cl.
CPC ..... *E21B 10/26* (2013.01); *E21B 7/20* (2013.01)

(58) Field of Classification Search
CPC ..... E21B 10/26; E21B 10/32
See application file for complete search history.

(56) References Cited

U.S. PATENT DOCUMENTS 2,997,119 A * 8/1961 Goodwin ..... E21B 10/66 175/286
4,440,247 A * 4/1984 Sartor ..... E21B 10/48 175/387

(Continued)

FOREIGN PATENT DOCUMENTS

CN 104747086 * 7/2015 ..... E21B 10/55
CN 209687417 U 11/2019

(Continued)

OTHER PUBLICATIONS

CN104747086 (Year: 2015).*

(Continued)

*Primary Examiner* — Cathleen R Hutchins
(74) *Attorney, Agent, or Firm* — NIXON & VANDERHYE, PC

(57) ABSTRACT

Here is presented a drill bit (1) which includes a pilot bit (2) and a reamer. The pilot bit (2) includes a body (3) and a drilling surface (4). The drill bit (1) is arranged to provide a hole for a pipe to be installed in the ground. The reamer comprises at least one wing (7) which is turnably pivoted to the body (3) of the pilot bit (2) such that the wing (7), when turned to a drilling position, extends outside the outer circle of the body (3) of the pilot bit (2) and, when turned to a position turned forwards from the drilling position, the wing (7) does not extend outside the outer circle of the body (3) of the pilot bit (2).

17 Claims, 3 Drawing Sheets

(56) References Cited

U.S. PATENT DOCUMENTS

| | | | | | |
|---|---|---|---|---|---|
| 5,141,063 | A * | 8/1992 | Quesenbury | ..... | E21B 10/322 175/286 |
| 5,787,999 | A | 8/1998 | Holte | | |
| 5,881,827 | A | 3/1999 | Ikeda et al. | | |
| 5,934,394 | A | 8/1999 | Fareham | | |
| 5,975,222 | A | 11/1999 | Holte | | |
| 2007/0144787 | A1 | 6/2007 | Pia | | |
| 2018/0179824 | A1 | 6/2018 | Ahonen | | |

FOREIGN PATENT DOCUMENTS

| | | | | | |
|---|---|---|---|---|---|
| DE | 4211048 | C1 * | 5/1993 | ..... | E21B 10/327 |
| DE | 29513325 | | 10/1995 | | |
| DE | 102010015474 | | 10/2011 | | |
| DE | 102014104516 | A1 | 10/2015 | | |
| EP | 0563561 | A1 | 10/1993 | | |
| EP | 4006298 | A1 | 6/2022 | | |
| GB | 2320270 | A | 6/1998 | | |
| GB | 2465653 | | 6/2010 | | |
| JP | H09-217578 | | 8/1997 | | |
| JP | 2001-032666 | | 2/2001 | | |
| JP | 2002-250194 | | 9/2002 | | |
| KR | 100919628 | | 9/2009 | | |
| KR | 20150110997 | A | 10/2015 | | |
| KR | 101664030 | B1 * | 10/2016 | ..... | E21B 10/633 |
| KR | 20190088704 | A | 7/2019 | | |
| WO | 0181708 | | 11/2001 | | |
| WO | 2005/085581 | | 9/2005 | | |
| WO | 2015/059341 | | 4/2015 | | |
| WO | 2018/078792 | | 5/2018 | | |
| WO | 2020189981 | A1 | 9/2020 | | |

OTHER PUBLICATIONS

International Search Report and Written Opinion of the International Search Authority for PCT/FI2023/050240, mailed Jul. 6, 2023, 12 pages.

Search Report for FI Application No. 20225378 dated Dec. 2, 2022, 6 pages.

Oct. 14, 2025 Office Action issued in Japanese Patent Application No. 2024-565120, pp. 1-6 [English translation included].

Nov. 18, 2025 Office Action issued in Chilean Patent Application No. 202403335, pp. 1-15.

* cited by examiner

DRILL BIT AND METHOD FOR DRILLING HOLE FOR PIPE TO BE INSTALLED IN GROUND

CROSS-REFERENCE TO RELATED APPLICATIONS

This application is the U.S. national phase of International Application No. PCT/FI2023/050240 filed May 3, 2023 which designated the U.S. and claims priority to FI 20225378 filed May 3, 2022, the entire contents of each of which are hereby incorporated by reference.

BACKGROUND OF THE INVENTION

The invention relates to a drill bit and particularly to the drilling of a hole for a pipe to be installed in the ground.

The size of the hole to be drilled for the pipe to be installed in the ground must be at least that of the outer diameter of the pipe. WO publication 2015059341 A1 discloses a drilling device which comprises a pilot bit drilling a centre portion of a hole and, detachably connectable to it, a ring bit, operating as an expander, which drills the outer circle of the hole, as well as an arrangement for pulling a casing pipe into said hole during drilling.

A problem with a drilling device of the kind referred to in the above example is that, as the drilling device is pulled out of said drilled hole so that the casing pipe is left in place in the drilled hole, it is also necessary to leave in place the ring bit drilling the outer circle of the hole at the bottom of the drilled hole at the end of the casing pipe.

Due to this, several different arrangements utilising movable wings as the reamers have been presented. Arrangements of this type are presented in publications GB 2465653 A, U.S. Pat. Nos. 5,934,394 A, 5,975,222 A, and WO 2005085581 A1, for instance. There is still a need to provide a new drill bit and a method for drilling a hole for a pipe to be installed in the ground.

BRIEF DESCRIPTION OF THE INVENTION

The object of the invention is thus to develop a new drill bit and a method for drilling a hole for a pipe to be installed in the ground. The arrangement according to the invention is characterised by what is disclosed in the independent claims. Some embodiments of the invention are disclosed in the dependent claims.

Here is presented a drill bit which includes a pilot bit and a reamer. The pilot bit includes a body and a drilling surface. The drill bit is arranged to provide a hole for a pipe to be installed in the ground. The reamer comprises at least one wing which is rotatably pivoted to the body of the pilot bit such that the wing, when turned to the drilling position, extends outside the outer circle of the body of the pilot bit and, when turned to a position turned forwards from the drilling position, the wing does not extend outside the outer circle of the body of the pilot bit. The drilling surface of the pilot bit can also be called a face area and the wing has a corresponding face area. The arrangement can also be described such that the wing can rotate to the front and again to the back, whereby an angle between the face area of the pilot bit and the face area of the wing will change. In such an arrangement, the hole is effectively made to the pipe to be installed in the ground. Furthermore, the wing can be reliably obtained in a position where the drill bit is totally removable from inside the pipe to be installed in the ground. Similarly, the area of the part being outmost in the wing can be obtained quite large, whereby the drilling surface of the wing on the outmost part of the drill bit is relatively large. The wing comprises at least one bracket and an outer part such that the outer part of the wing is arranged to turn the flow of flushing medium. Then, the arrangement also controls the flow of the flushing medium desirably. According to an embodiment, there are at least two wings as described above. A distance between the wings can be obtained quite small, which provides good drilling properties. The wings can be shaped simple and their manufacture is easy.

The wing comprises at least one bracket and an outer part. The shape of such a wing is simple. The wing can be pivoted from the bracket. The outer part can be formed of desired size and shape. The outer part can be e.g. wider than the bracket.

According to an embodiment, the wing comprises an outer part which is curved at least of its outer surface. The shape of the outer part is then such that the drill bit works reliably.

According to an embodiment, the drilling surface of the pilot bit includes flushing grooves. The wing can include an outer part such that the flushing groove is arranged to convey flushing medium towards the outer part of the wing, and the outer part of the wing is arranged to turn the flow of the flushing medium towards the back part of the drill bit. Then, the flow of the flushing medium can be controlled in a desired way.

According to an embodiment, the wing includes from the outer part towards the centre part of the drill bit at least two brackets, between which, the flushing groove is arranged. Thus, the flow of the flushing medium can be controlled particularly accurately and reliably.

According to an embodiment, the drill bit includes (in the pilot bit body) in connection with each wing a pivot pin around the centre axle of which the wing is arranged turnable. This arrangement enables a mechanism simple of its construction and, thus, the rotation of the wing is obtained reliable.

According to an embodiment, the centre axle of the pivot pin is in a substantially perpendicular direction in relation to the direction of the centre axis of the drill bit. This arrangement also increases the reliability of the construction. In this connection, "in a substantially perpendicular direction" refers to the angle between the direction of the centre axis of the pivot pin and the centre axis of the drill bit being between 70-110°, preferably between 80-100°.

According to an embodiment, the wing includes at least two brackets, at the end of which, the pivot pin is arranged. Such a wing is preferable of its shape, and the pivoting of the wing can also be implemented reliably.

According to an embodiment, said at least two brackets include their own separate pivot pins at their end. Then, the two brackets are not pivoted only by one pivot pin, whereby there is no need to drill a long hole through the pilot bit for the pivot pin. Hence, the body of the pilot bit can be formed durable.

According to an embodiment, the wing includes a drilling surface, whereby there are drilling buttons on the drilling surface of the pilot bit and the drilling surface of the wing.

According to an embodiment, the body of the pilot bit includes a shoulder for a casing shoe of the pipe to be installed in the ground, whereby the pipe to be installed in the ground is pullable inside the ground by means of the shoulder. Such an arrangement is simple and reliable for the installation of pipes to be installed in the ground.

According to an embodiment, the wing, when turned to the drilling position, is substantially perpendicular in relation to the direction of the centre axis of the drill bit. This type of structure is simple and reliable. In this connection, "substantially perpendicular" refers to, when the wing is turned to the drilling position, the angle between the direction of its face area and the centre axis of the drill bit being between 70-110°, preferably between 80-100°.

According to an embodiment, the wing, when turned to the position turned forwards from the drilling position, is turned for at least 30° forwards from the direction perpendicular to the direction of the centre axis of the drill bit. This arrangement ensures that the removal of the drill bit from inside the pipe to be installed in the ground is easy and simple.

According to an embodiment, a blank of the wing is formed by flame-cutting a sheet. Then, the manufacture of the wings is easy and simple. Loss of material is minimal. The wings can be made of abrasion-resistant steel, for instance. Furthermore, the wings can be formed e.g. of engineering steel of round rod or forged blank.

According to an embodiment, a method for drilling a hole for a pipe to be installed in the ground employs a drill bit presented here. When drilling, the wing is turned to the drilling position to extend outside the outer circle of the body of the pilot bit. When removing the drill bit from inside the pipe, the wing is turned to a position turned forwards such that the wing does not extend outside the outer circle of the body of the pilot bit. This type of solution is simple and reliable.

BRIEF DESCRIPTION OF THE DRAWINGS

The invention will now be described in closer detail in connection with some embodiments and with reference to the accompanying drawings, in which.

DETAILED DESCRIPTION OF THE INVENTION

Figure 1:
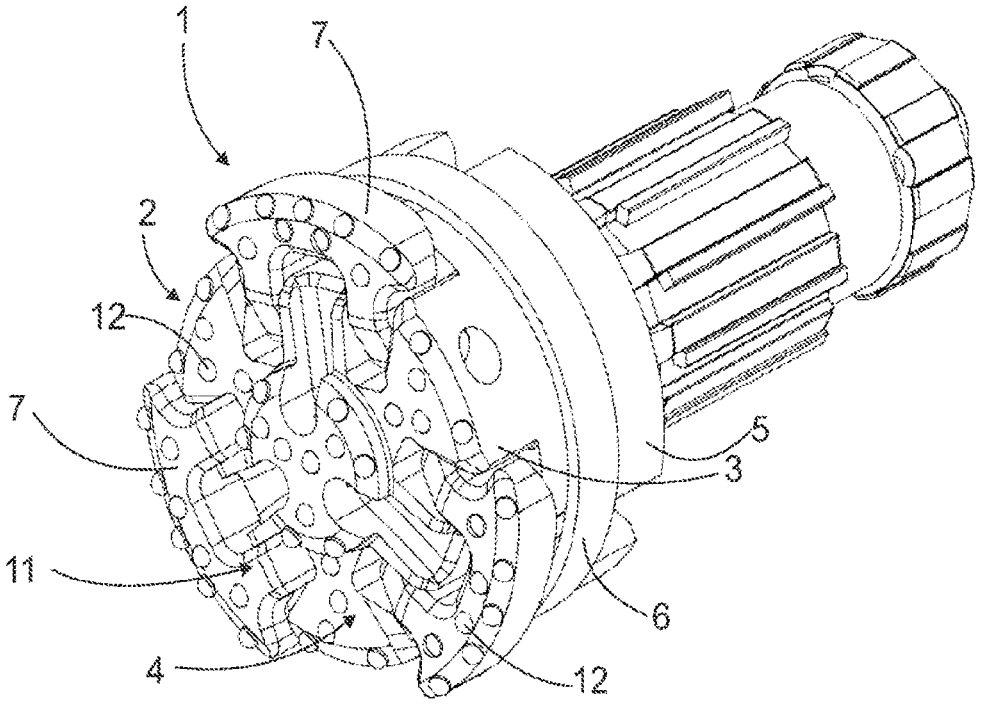
FIG. 1 is a schematic front diagonal view of a drill bit, the drill bit being in a drilling position.
Figure 2:
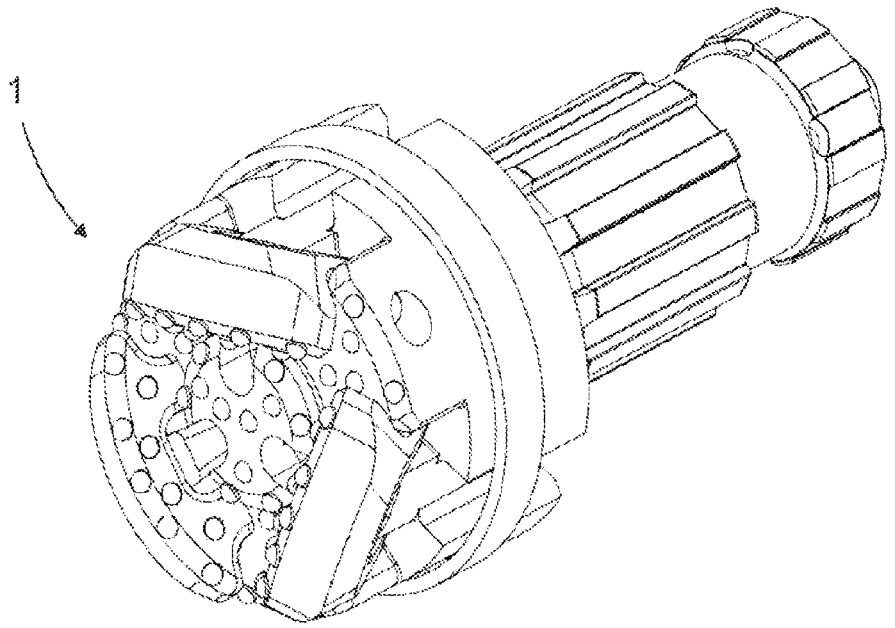
FIG. 2 is a schematic front diagonal view of the drill bit of FIG. 1, the drill bit being in a position where it is removable from inside a pipe.

FIG. 1 shows a drill bit 1 which includes a pilot bit 2. The pilot bit 2 includes a body 3 and a drilling surface 4. The drill bit 1 further includes wings 7. The wings 7 provide a reamer of the drill bit 1 and they are pivoted turnably to the body 3 of the pilot bit 2.

Figure 3:
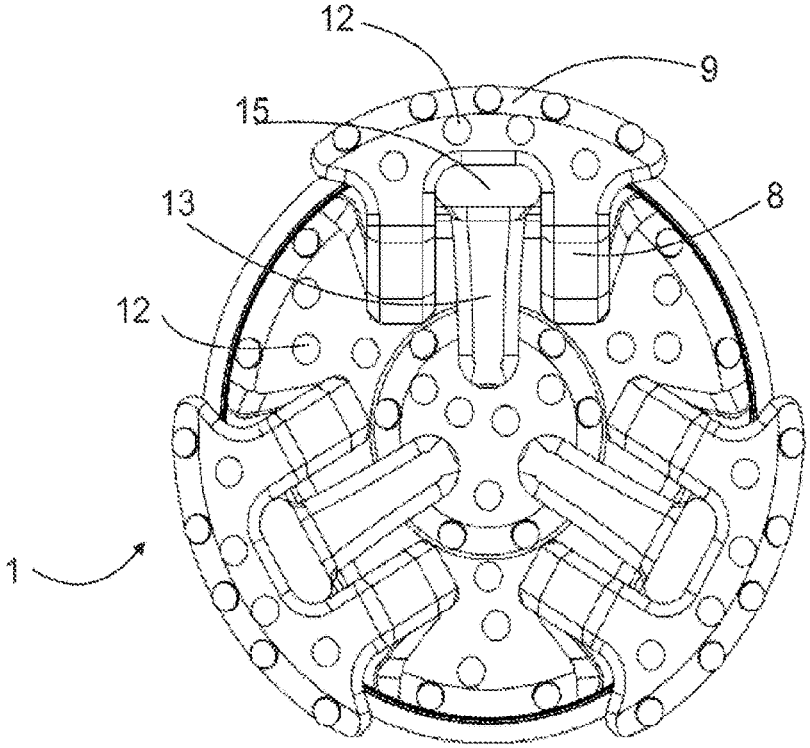
FIG. 3 is a schematic front view of the drill bit of FIG. 1.

When the wings 7 are turned to the drilling position in a way illustrated in FIG. 1, the wings 7 extend outside the outer circle of the body 3 of the pilot bit 2. This is also shown in FIG. 3. Each wing 7 includes a wing drilling surface 11. The drilling surface 4 of the pilot bit and the drilling surfaces 11 of the wings can include drilling buttons 12. When drilling, the drill bit 1 is moved to-and-fro and rotated, that is, the drill bit 1 is used for percussive and rotating drilling. The drill bit 1 can be used for drilling holes in the ground and also in a hard material, such as rock.

Figure 5:
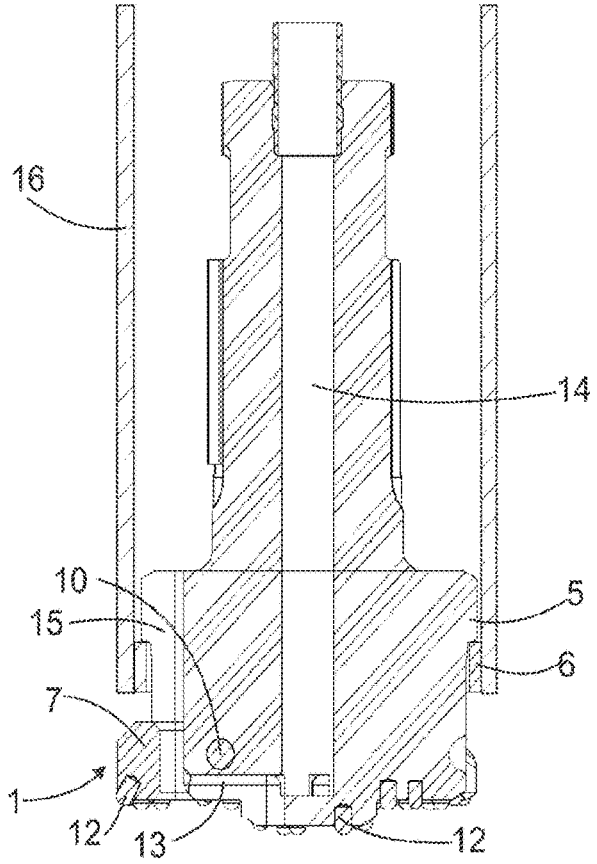
FIG. 5 is a schematic cross-sectional side view of the drill bit of FIG. 1, the drill bit in the drilling position.
Figure 6:
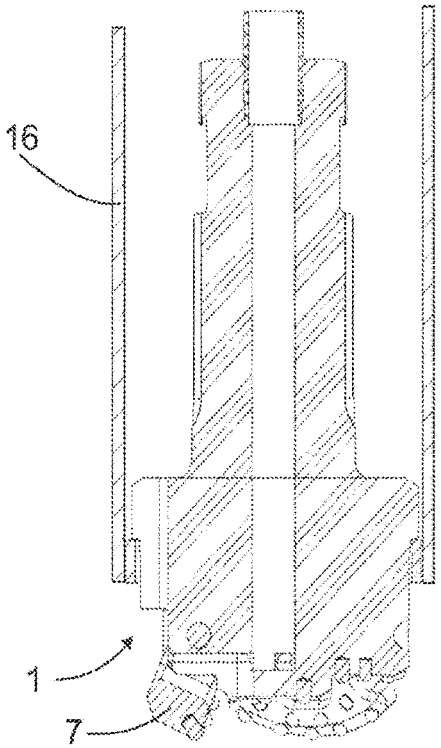
FIG. 6 is a schematic cross-sectional side view of the drill bit of FIG. 1, the drill bit being in a position where it is removable from inside a pipe.

The pilot bit body 3 can include a shoulder 5. The shoulder 5 can be arranged against a casing shoe 6. The casing shoe 6 can be fastened at the bottom end of a pipe to be installed in the ground. Then, the pipe to be installed in the ground can be installed in the ground by means of the shoulder 5 and the casing shoe 6. For clarity, FIGS. 1-4 do not show the pipe to be installed in the ground to which the casing shoe 6 is fastened. FIGS. 5 and 6 show the pipe 16 to be installed in the ground. The pipe to be installed in the ground can be installed or set permanently in the ground. Instead of using the shoulder and the casing shoe, the pipe 16 can be arranged in the ground e.g. such that the pipe is pressed, driven and/or vibrated into the ground from the top end of the pipe. The diameter of the pipe 16 to be installed in the ground can be e.g. 100-1,000 mm.

The pilot bit 2 and the wings 7 provide a hole for the pipe to be installed in the ground. In the drilling position, the wings 7 extend so much outside the outer circle of the body 3 of the pilot bit 2 that the size of the provided hole is at least that of the pipe to be installed in the ground.

Pushing the drill bit 1 in the drilling direction provides the extension of the drilling surface, that is, the wings 7 turning into the drilling position. When the drill bit 1 is being lifted out of the hole, the wings 7 turn into the position shown in FIG. 2. When turned to this position turned forwards from the drilling position, the wings do not extend outside the outer circle of the body of the pilot bit. When turned forwards, the wings 7 are turned to the drilling direction towards the bottom of the drilled hole. Then, the drill bit 1 can be pulled out from the inside of the pipe installed in the ground. Then, the wings 7 do not extend outside the outer circle of the body 3 of the pilot bit 2. In the embodiment of the figures, the wings 7 do not, in this position, extend outside the circle defined by the inner diameter of the casing shoe 6. The circle, outside of which the wings 7 do not extend, can be all over smaller for the width of the shoulder 5 than the outer diameter of the body 3 of the pilot bit 2.

The wing 7 comprises at least one bracket 8 and an outer part 9. The outer part 9 can be e.g. wider than the bracket 8. The width of the outer part 9 can be made as large as possible, whereby the drill bit 1 also includes drilling surface as much as possible on the outer circle. When the drill bit 1 includes a lot of drilling surface also on its outer circle, it is also possible to provide as many as possible drilling buttons 12 on the outer circle. The width of the outer parts 9 can be e.g. such that the combined width of the outer parts 9 is greater than the combined width of the gaps between the outmost parts of the wings 7. The outer part 9 can be curved at least of its outer surface.

The bracket 8 extends from the outer part 9 towards the centre part of the pilot bit 2. For example in the embodiment of the figures, the wing 7 includes two brackets 8, whereby they both extend towards the centre part of the pilot bit 2 even though neither of them does not extend towards the centre point of the pilot bit, but slightly past it.

The wing 7 can be pivoted from the bracket 8. In the body 3 of the pilot bit 2, the drill bit 1 can include in connection with each wing 7 a pivot pin 10 around the centre axis of which the wing 7 is arranged turnable. The pivot pin 10 can be arranged through an end of the bracket 8. The pivot pin 10 can be locked to the body 3 of the pilot bit 2 e.g. by a lock ring made of polyurethane. Furthermore, the pivot pin can be locked in some other way, such as by a locking pin or any mechanical stop which prevents the pivot pin from sliding out.

Figure 4:
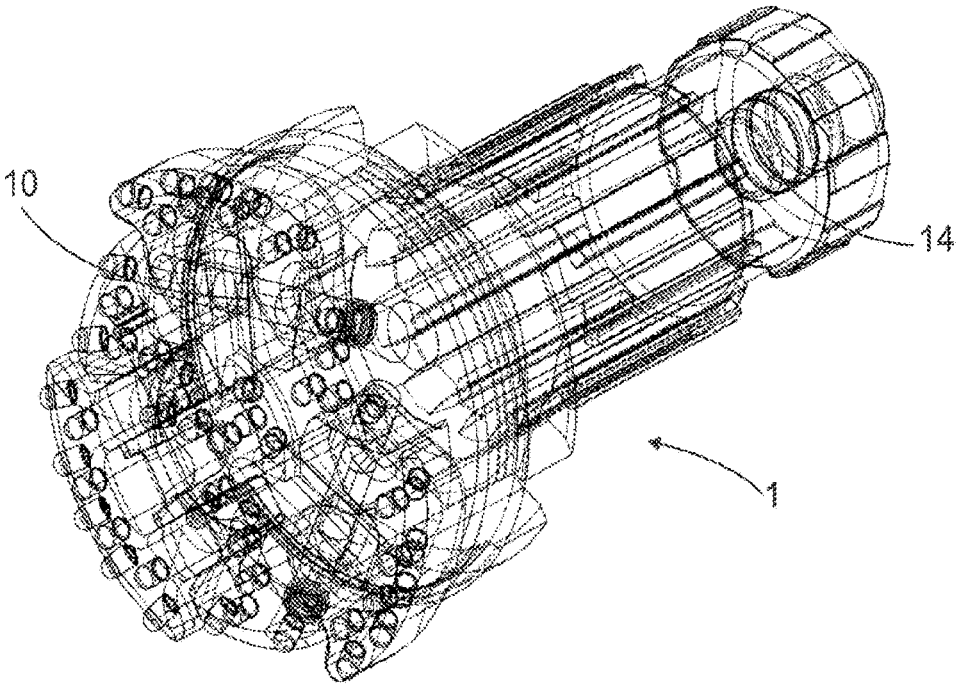
FIG. 4 is a schematic front diagonal view of the drill bit of FIG. 1, a pilot bit body being shown transparent.

The wing 7 can include two or more brackets 8 and then the wing 7 can be pivoted by one pivot pin 10 which extends through all of the brackets 8 in a way illustrated in FIG. 4. On the other hand, said at least two brackets 8 can include their own separate pivot pins 10 at their end. Then, the two brackets 8 are thus not pivoted only by one pivot pin 10, whereby there is no need to drill a long hole through the body 3 of the pilot bit 2 for the pivot pin 10.

The centre axis of the pivot pin 10 can be in a substantially perpendicular direction in relation to the direction of the centre axis of the drill bit 1. Then, the centre axis of the pivot pin can be in a perpendicular direction in relation to the direction of the centre axis of the drill bit 1 or differ from the perpendicular direction e.g. at the most 20°, preferably at the most 10° into each direction.

The drilling surface 4 of the pilot bit 2 can include flushing grooves 13. Flushing medium, such as compressed air, can be supplied towards the front surface of the drill bit 1 along e.g. a flushing channel 14 in the centre of the drill bit 1. The drill bit 1 can include the drilling surface 4 of the pilot bit 2 at the end of the flushing channel 14, whereby there is some body structure at the end of the flushing channel 14. Hence, the flushing medium does not at least totally flow in the drilling direction, that is, the axial direction of the drill bit 1 towards the ground to be drilled, but the flushing medium flow at least partially turns into the radial direction of the drill bit 1.

After the rinsing channel 14, at least part of the flushing medium flow flows in the flushing grooves 13 from the centre part of the drill bit 1 towards the outer edge of the drill bit. The rinsing groove 13 conveys the rinsing medium towards the outer part 9 of the wing 7. The outer part 9 of the wing 7 is arranged to turn the flow of the flushing medium to a side groove 15 and towards the back part of the drill bit 1. Then, the flushing medium can flow upwards inside the pipe to be installed in the ground and flow of the flushing medium into the ground is avoided.

In the embodiment of the figures, the wing 7 includes at least two brackets 8 from the outer part 9 towards the centre part of the drill bit 1. The flushing groove 13 is arranged between these brackets 8.

The outer part 9 of the wing directs the flow of the flushing medium into a desired direction. For the flow of the flushing medium, the drilling surface does not necessarily need flushing grooves. The flushing medium flows between the drilling surface and the wing. The surface of the wing on the side of the drilling surface can include a rinsing groove for the flushing medium. On the other hand, the flushing medium can be arranged both on the drilling surface and the wing surface or, then, only one or none of the them include the flushing groove.

If the wing includes two brackets 8, the wing can be constructed such that the brackets 8 are connected to each other by the material of the wing for more than a half of the length of the bracket. Such a wing is sturdier of its construction than a construction where the brackets do not combine until in the vicinity of the outer part 9 of the wing. When the brackets are connected to each other by the material of the wing for more than a half of the length of the bracket, the wing directs the flow of the flushing medium reliably. It is then also possible to provide a flushing groove for the flushing medium at the point of the wing combining the brackets.

When turned to the drilling position, the wings 7 can be substantially perpendicular in relation to the direction of the centre axis of the drill bit 1. Then, the wings 7, when turned to the drilling position, can be perpendicular in relation to the direction of the centre axis of the drill bit 1 or differ from the perpendicular direction e.g. at the most 20°, preferably at the most 10° into each direction.

The wings 7, when turned to the position turned forwards from the drilling position, can be rotated for at least 30° forwards from the direction perpendicular to the direction of the centre axle of the drill bit 1. According to an embodiment, the wings 7, when turned to the position rotated forwards from the drilling position, are turned at least 45° forwards from the direction perpendicular to the direction of the centre axis of the drill bit 1. The amount the wings need to turn when turned into the direction turned forwards depends on the size class and geometry of the bit and the amount of space available. In a larger size class, a sufficient change in the outer diameter of the bit can be provided with a smaller change in the angle than in a smaller size class. In the embodiment of the figures, the wings rotate for 66°.

Preferably, the wings 7 can turn for less than 90°. Then, the wings 7 are able to turn into the drilling position when pressing the drill bit 1 against the ground without needing a separate actuator to move them. It is thus possible to move the wings forwards and backwards by an actuator. In connection with the drill bit 1, the constructions are under a very severe load. Therefore, it is preferable to provide the drill bit 1 without actuators moving the wings 7. Then when the drill bit 1 is moved forwards, this causes the wings 7 to turn to the drilling position and, when the drill bit 1 is moved backwards, this causes the wings 7 to turn to the position turned forwards from the drilling position.

A blank of the wing 7 can be formed by flame-cutting a sheet. The wings can be made of abrasion-resistant steel, for instance. Furthermore, the wings can be formed e.g. of engineering steel of round rod or forged blank.

A method for drilling a hole for a pipe to be installed in the ground can employ a drill bit 1 presented here. When drilling, the wings 7 are turned to the drilling position to extend outside the outer circle of the body 3 of the pilot bit 2. When removing the drill bit 1 from inside the pipe, the wings 7 are in the position turned forwards from the drilling position such that the wings 7 do not extend outside the outer circle of the body 3 of the pilot bit 2. Preferably, this turning of the wings 7 to the drilling position and to the position turned forwards from the drilling position thus takes place without actuators by moving the drill bit 1 forwards and backwards. The flow of the rinsing medium is turned by means of the outer part 9 of the wing.

Those skilled in the art will find it obvious that, as technology advances, the basic idea of the invention can be implemented in many different ways. The invention and its embodiments are thus not restricted to the examples described above but may vary within the scope of the claims.

The invention claimed is:

1. A drill bit which includes a pilot bit, which includes a body and a drilling surface, and a reamer, wherein the drill bit is configured to provide a hole for a pipe to be installed in the ground, wherein the reamer comprises at least one wing which is turnably pivoted to the body of the pilot bit such that each of the at least one wing, when turned to a drilling position, extends outside an outer circle of the body of the pilot bit and, when turned to a position turned forwards from the drilling position each of the at least one wing does not extend outside the outer circle of the body of the pilot bit, each of the at least one wing comprises at least one bracket and an outer part, the drill bit comprises a flushing channel configured to supply a flow of flushing medium to the drilling surface, and the outer part of each of the at least one wing is configured to turn the flow of flushing medium from the drilling surface towards a back part of the drill bit, wherein the pilot bit is configured to direct the flow of flushing medium along the drilling surface in a radially outward direction toward the outer part of each of the at least one wing, and each of the at least one wing is configured to turn the flow of flushing medium towards the back part of the drill bit at a location between the at least one bracket and the outer part of the wing.

2. The drill bit according to claim 1, wherein the at least one wing comprises two or more wings.

3. The drill bit according to claim 1, wherein the outer part of each of the at least one wing is curved along at least part of an outer surface thereof.

4. The drill bit according to claim 1, wherein there are flushing grooves on the drilling surface of the pilot bit such that each flushing groove is configured to convey the flushing medium towards the outer part of a respective one of the at least one wing.

5. The drill bit according to claim 4, wherein the at least one bracket of each of the at least one wing includes two or more brackets, between which a corresponding one of the flushing grooves is arranged.

6. The drill bit according to claim 4, wherein each of the at least one wing comprises an internal passage that is fluidly connected to a corresponding one of the flushing grooves and is configured to convey the flow of flushing medium from said corresponding one of the flushing grooves to the back part of the drill bit.

7. The drill bit according to claim 1, wherein the drill bit includes in connection with each of the at least one wing a pivot pin, around a center axis of which the wing is arranged to turn.

8. The drill bit according to claim 7, wherein the center axis of the pivot pin is in a substantially perpendicular direction in relation to a direction of the center axis of the drill bit.

9. The drill bit according to claim 7, wherein the at least one bracket of each of the at least one wing includes two or more brackets, at the end of which the pivot pin is arranged.

10. The drill bit according to claim 9, wherein the two or more brackets are connected to each other by a material of the wing for over a half of a length of each of the two or more brackets.

11. The drill bit according to claim 9, wherein each of said at two or more brackets include their own separate pivot pins at the ends of the bracket.

12. The drill bit according to claim 1, wherein the at least one wing includes a drilling surface, wherein the drilling surface of the pilot bit and the drilling surface of the at least one wing include drilling buttons.

13. The drill bit according to claim 1, wherein the body of the pilot bit includes a shoulder for a casing shoe of the pipe to be installed in the ground, wherein the pipe to be installed in the ground is pullable inside the ground via the shoulder.

14. The drill bit according to claim 1, wherein each of the at least one wing, when turned to the drilling position, is substantially perpendicular in relation to the direction of a center axis of the drill bit.

15. The drill bit according to claim 1, wherein each of the at least one wing, when turned to the position turned forwards from the drilling position, is turned for at least 30° forwards from the direction perpendicular to the direction of a center axis of the drill bit.

16. A method for drilling a hole for a pipe to be installed in the ground, the method comprising using the drill bit according to claim 1, when drilling, turning the at least one wing to the drilling position to extend outside the outer circle of the body of the pilot bit, and when removing the drill bit from inside the pipe, the at least one wing being in a position turned forwards from the drilling position such that the at least one wing does not extend outside the outer circle of the body of the pilot bit.

17. The drill bit according to claim 1, wherein each of the at least one wing comprises an internal passage that is configured to direct the flow of flushing medium towards the back part of the drill bit.

* * * * *